US005319919A

United States Patent [19]

Nakayama et al.

[11] Patent Number: 5,319,919

[45] Date of Patent: Jun. 14, 1994

[54] METHOD FOR CONTROLLING GAS TURBINE COMBUSTOR

[75] Inventors: Yoshiharu Nakayama; Isao Sato, both of Hitachi; Hiraku Ikeda, Katsuta; Michio Kuroda; Nobuyuki Iizuka, both of Hitachi; Kazuhiko Kumata, Katsuta; Fumiyuki Hirose, Hitachi; Akira Shimura, Hitachi; Minoru Takaba, Hitachi; Shoei Takahashi, Hitachi, all of Japan

[73] Assignee: Hitachi, Ltd., Tokyo, Japan

[21] Appl. No.: 984,483

[22] Filed: Dec. 2, 1992

[30] Foreign Application Priority Data

Dec. 2, 1991 [JP] Japan ..... 3-341701

[51] Int. Cl.[5] ..... F02C 9/28

[52] U.S. Cl. ..... 60/39.03; 60/39.091; 60/39.27

[58] Field of Search ..... 60/39.03, 39.27, 39.281, 60/39.29, 39.465, 747, 39.091

[56] References Cited

U.S. PATENT DOCUMENTS

| | | | |
|---|---|---|---|
| 3,584,459 | 6/1971 | Amann | 60/39.29 |
| 3,977,182 | 8/1976 | Schroff | 60/39.29 |
| 4,138,842 | 2/1979 | Zwick | 60/39.29 |
| 4,380,894 | 4/1983 | Abo et al. | 60/39.281 |
| 4,648,242 | 3/1987 | Griesinger | 60/39.03 |
| 4,766,721 | 8/1988 | Iizuka et al. | 60/39.29 |
| 5,121,597 | 6/1992 | Urushidani et al. | 60/747 |
| 5,127,229 | 7/1992 | Ishibashi et al. | 60/747 |
| 5,201,181 | 4/1993 | Ohmori et al. | 60/39.03 |

FOREIGN PATENT DOCUMENTS

| | | | |
|---|---|---|---|
| 8322 | 1/1989 | Japan | 60/39.465 |

*Primary Examiner*—Louis J. Casaregola

*Attorney, Agent, or Firm*—Antonelli, Terry, Stout & Kraus

[57] ABSTRACT

A method for controlling a gas turbine combustor which comprises nozzles for injecting fuel into a combustor and which serves to combust the fuel with air in a combustion chamber so as to rotatively drive a gas turbine by combustion gas compressed as a result of combustion of a fuel, wherein the ratio of a flow rate of fuel supplied into the combustor to a flow rate of air supplied into the combustor is changed in accordance with at least one of the states of fuel, air and rotational frequency of the turbine.

29 Claims, 3 Drawing Sheets

METHOD FOR CONTROLLING GAS TURBINE COMBUSTOR

BACKGROUND OF THE INVENTION AND RELATED ART STATEMENT

The present invention relates to a method for controlling a gas turbine combustor, and more particularly, to a method for controlling a gas turbine combustor comprising a first for injecting inject fuel into the combustor and a second nozzle for injecting into the combustor a fuel used to form a flame for promoting ignition of the fuel injected through the first nozzle.

A conventional method for controlling a gas turbine combustor disclosed in Japanese Patent Unexamined Publication No. 2-208417 is concerned with a combustor which comprises a main fuel nozzle (F1 nozzle) and a secondary fuel nozzle (F2 nozzle) and which is capable of reducing the NOx value in combustion gas, with this combustor further comprising an auxiliary starting fuel nozzle. The auxiliary starting fuel nozzle Fs is not used during an ordinary operation but only in starting and accelerating the gas turbine alone, so that the fuel flow rate thereof can be maintained constant at all times.

OBJECT AND SUMMARY OF THE INVENTION

An object of the present invention is to provide a method for controlling a gas turbine combustor which is capable of constantly maintaining a proper combustion state in a gas turbine combustor and preventing a flame from being extinguished.

According to the present invention, there is provided a method for controlling a gas turbine combustor which comprises a first nozzle means for injecting fuel into the combustor and a second nozzle means for injecting fuel used to form a flame for promoting ignition of the fuel injected through the first nozzle means into the combustor so as to allow the fuel to be combusted with air in a combustion chamber, wherein a ratio of the flow rate of fuel supplied into the combustor to the flow rate of air supplied into the combustor is changed in accordance with at least one of the state of fuel before combustion, the state of air before combustion and the state of rotational acceleration of the turbine.

According to the present invention, since the ratio of the flow rate of fuel supplied into the combustor to the flow rate of air supplied into the combustor is changed in accordance with at least one of the states of fuel, air and rotational acceleration of the turbine, even if one of the states of fuel, air and rotational acceleration of the turbine is changed, a fuel rich state in which the flow rate of fuel supplied into the combustor is too large as compared with the flow rate of air supplied into the combustor so that the flame is extinguished and a fuel lean state in which the flow rate of fuel supplied into the combustor is too small as compared with the flow rate of air supplied into the combustor so that the flame is extinguished can be prevented from taking place, with the result that a proper combustion state in the gas turbine combustor can be maintained constantly, thereby preventing the flame from being extinguished.

DETAILED DESCRIPTION OF PREFERRED EMBODIMENTS

Figure 1:
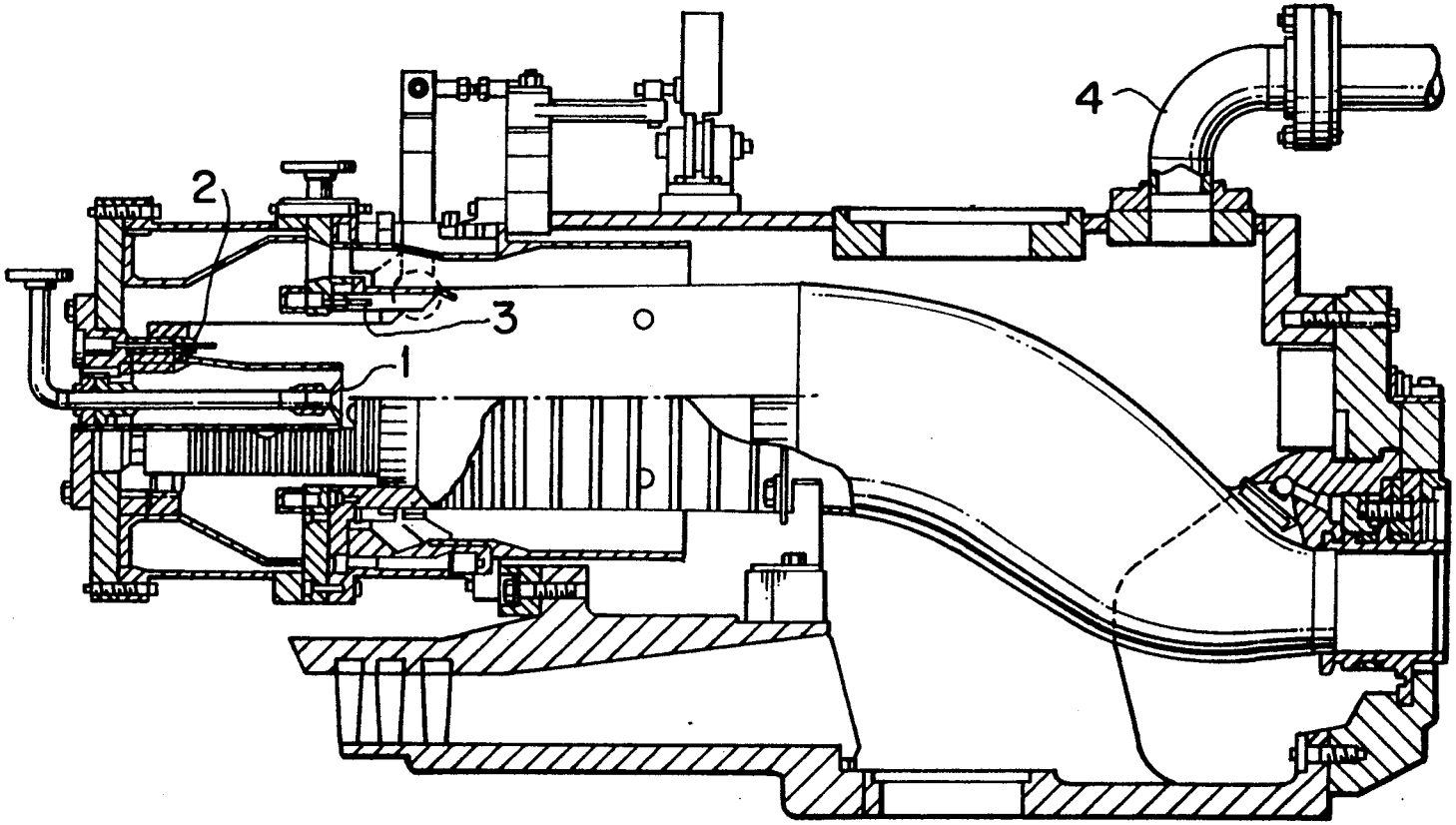
FIG. 1 is a schematic sectional view for illustrating a gas turbine combustor to which a method of the present invention is to be applied.

A gas turbine combustor to which a method of the present invention is to be applied has a conventionally well-known construction and comprises, as shown in FIG. 1, an auxiliary starting fuel nozzle 1 (Fs nozzle) for diffusion combustion, a main fuel nozzle 2 (F1 nozzle) 2 for premixed or lean-burn combustion, a secondary stage fuel nozzle 3 (F2 nozzle) for premixed or lean-burn combustion and a horn bleeder pipe 4. And, the Fs nozzle 1 and the F1 nozzle 2 constitute a first stage combustion zone. A secondary stage combustion zone is constituted by the F2 nozzle 3.

In this type of combustor, when the turbine is started and accelerated, the operation thereof is controlled until the turbine rotational frequency reaches about 65% of the rated rotational frequency by controlling the supply of fuel through the Fs nozzle 1 and the F1 nozzle, 2 that is, by controlling the combustion in the first stage combustion zone. Subsequently, fuel is supplied only through the F1 nozzle 2 and the operation is continued until the rated rotational frequency is reached and a certain degree of load can be taken out. Supply of fuel to the F2 nozzle 3 is controlled in accordance with the magnitude of the load to be taken out later.

Figure 2:
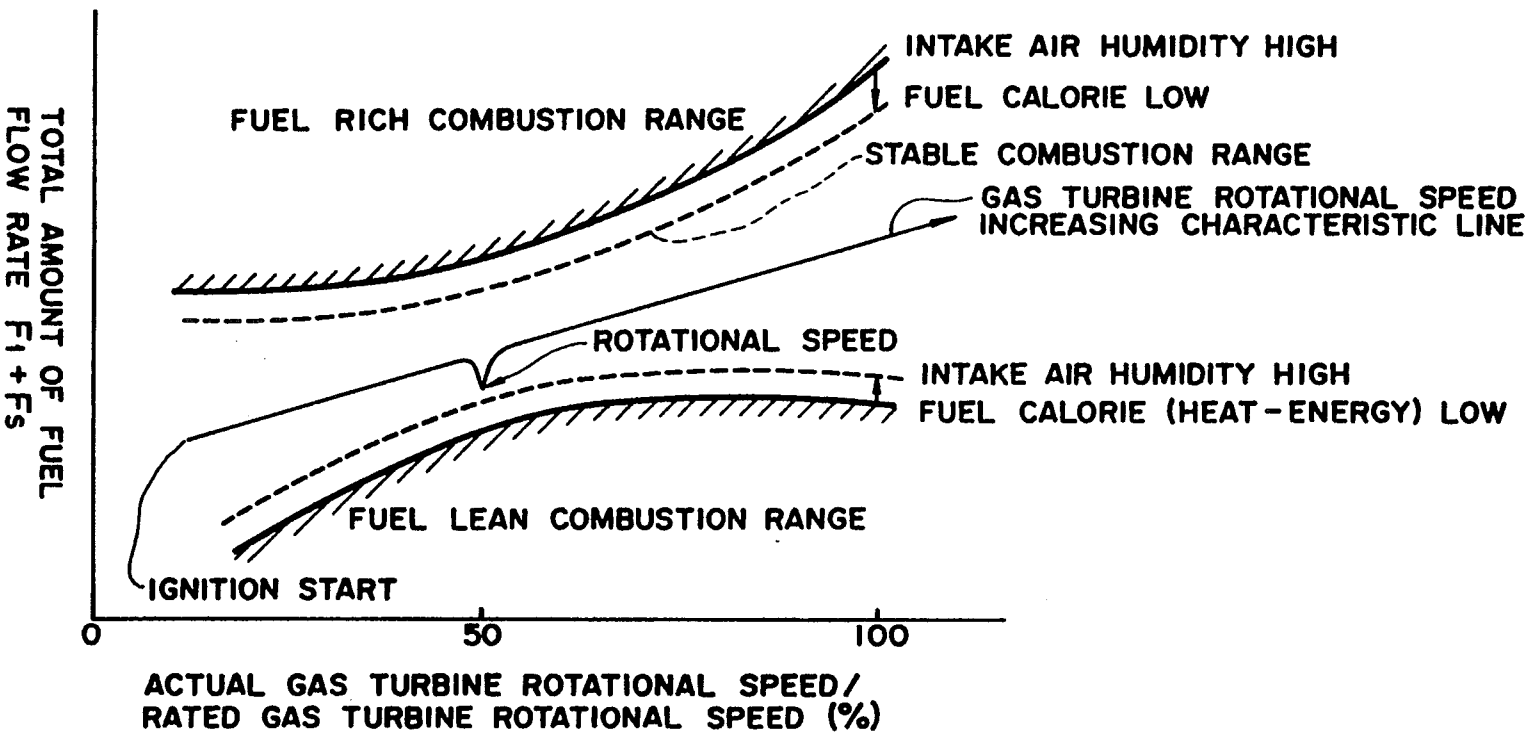
FIG. 2 is a graphical illustration of a desired relationship between the gas turbine output rotational frequency and the total flow rate of fuel supplied to the gas turbine combustor required for preventing a flame out in achieving a specified gas turbine acceleration characteristic in the gas turbine combustor.

FIG. 2 shows the relationship between the total fuel flow rate (the sum of fuel supplied through the F1 and Fs nozzles 21) and the rotational frequency of the gas turbine obtained when the turbine is started and accelerated. In the graph, of FIG. 2 hatched portions represent the ranges of the fuel rich limit and the fuel lean limit.

After the gas turbine is ignited, supply of the total fuel is performed in accordance with the gas turbine accelerating curve shown in FIG. 2, with this gas turbine accelerating curve being in the stable combustion range defined between the fuel rich limit and the fuel lean limit. However, the ranges of the fuel rich limit and the fuel lean limit are changed as shown by dotted lines due to increase of the atmospheric humidity and reduction of the calorific value of the fuel, so that the stable combustion range is reduced.

In this state, as the turbine is accelerated and the rotational frequency thereof if maintained (that is, as the turbine is operated for a fixed time at a rotational frequency corresponding to about 50% of the rated speed for the purpose of preheating a waste heat boiler or the like which is not shown), the total fuel flow rate is reduced temporarily. At this time the state of combustion in the first stage combustion zone in which the fuel supplied through the F1 and Fs nozzles 211 is burned is made to approach the fuel lean limit.

As described later, according to the the present invention, in order to avoid appearance of such state, the fuel air ratio in the first stage combustion zone is controlled so as to prevent the combustion state therein from approaching the fuel lean limit.

After the rotational frequency of the turbine is maintained, when is it intended to further accelerate the turbine, the total fuel flow rate is increased. However, as the rotational frequency of the turbine reaches about 65% of the rated rotational frequency, the flame of the Fs nozzle 1 is put out and, thereafter, the accelerating operation is performed only by the F1 nozzle 2.

In this case, if the supply of fuel to the Fs nozzle 1 is suddenly stopped, the flame of the F1 nozzle 2 is put out and the state of the gas turbine is unstable. In order to prevent this, according to the present invention, the supply of fuel to the Fs nozzle 1 is slowly stopped.

Figure 3:
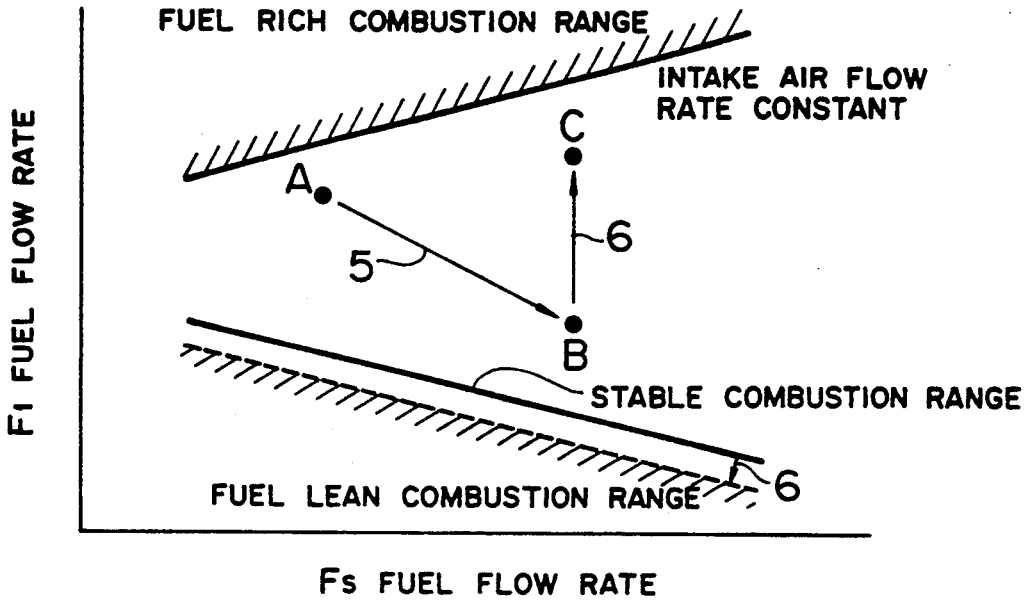
FIG. 3 is a graphical illustration of a desired relationship between the flow rate of fuel of a second nozzle means through which the fuel used to form a flame for promoting ignition of the fuel injected through a first nozzle means is injected into the combustor and the flow rate of fuel of the first nozzle means through which the fuel is injected into the combustor required for preventing the flame from being put out.

FIG. 3 shows the results of an experiment conducted to determine the relationship between the stable combustion limit of the F1 nozzle 2 and the fuel flow rate of the Fs nozzle 1 with the amount of air being maintained constant (at a constant rotational frequency of the turbine). By referring to the graph of FIG. 3, description will be given below as to operation of the combustor in accordance with the embodiment of the present invention.

It is assumed here that, in a starting and an accelerating operation, the relationship between the fuel flow rate of the Fs nozzle 1 and the fuel flow rate of the F1 nozzle is designated by a point A in FIG. 3. In this state, the state of combustion in the first stage combustion zone is near the fuel rich limit. In such case, according to the present invention, control is performed such that the fuel flow rate of the Fs nozzle 1 is increased (in this case, since the sum of the fuel flow rates of the F1 and Fs nozzles 2, 1 is constant, the fuel flow rate of the F1 nozzle 2 is reduced).

By so doing, according to the present invention, the relationship between the fuel flow rate of the Fs nozzle 1 and the fuel flow rate of the F1 nozzle 2 moves along the arrow 5 to a point B in FIG. 3, with the result being that the tolerance on the fuel rich limit for the first stage combustion zone can be made larger.

Further, in starting and accelerating operation, if the relationship between the fuel flow rate of the Fs nozzle 1 and the fuel flow rate of the F1 nozzle 2 is shown by a point which represents that the state of combustion in the first stage combustion zone is near to the fuel lean limit, such as the point B of FIG. 3, according to the present invention, an extraction of intake air is effected so as to perform such control that air for combustion is drawn through the horn bleeder pipe 4 to thereby increase the fuel/air ratio in the first stage combustion zone.

By so doing, according to the present invention, the relationship between the fuel flow rate of the Fs nozzle 1 and the fuel flow rate of the F1 nozzle 2 moves in the direction of the arrow 6 to a point C in FIG. 3, with the result being that the tolerance on the fuel lean limit for the first stage combustion zone is increased.

Figure 4:
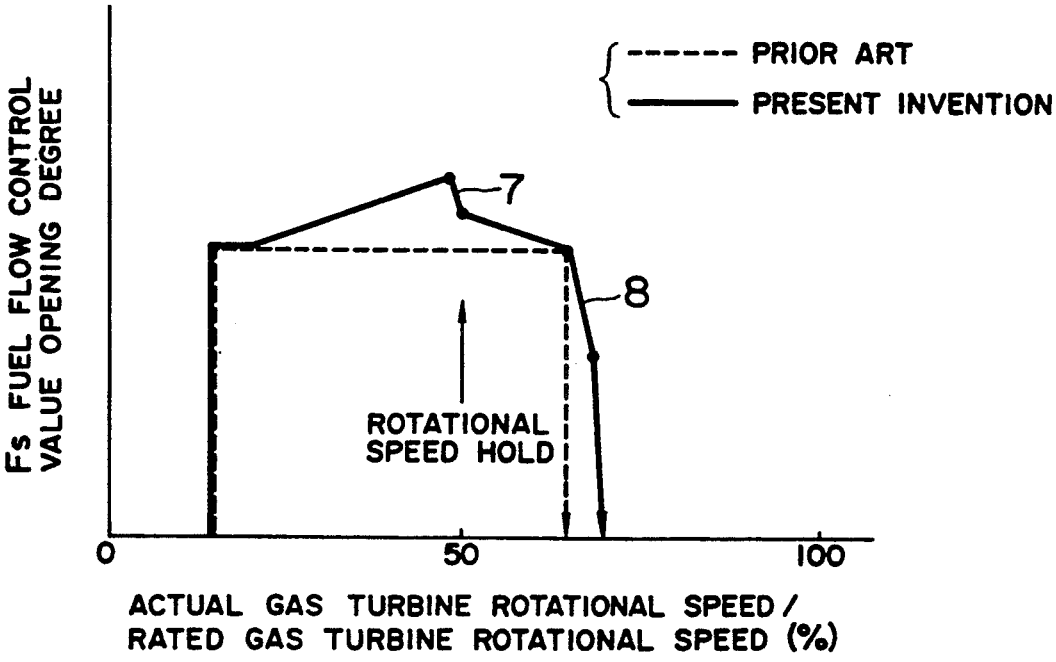
FIG. 4 is a graphical illustration of a desired relationship between the gas turbine output rotational frequency and the opening of a valve serving control the fuel flow rate of the second nozzle means required for preventing the flame out.

In accordance with another operating method of the present invention, reference is made to FIG. 4 in which the ordinate represents the Fs nozzle 1 fuel flow rate regulating valve opening and the abscissa represents the rotational frequency of the gas turbine.

The method of FIG. 4 is concerned with preventing the first stage combustion zone from being brought into the state below the fuel lean limit resulting from the reduction of the total fuel flow rate caused when the rotational frequency of the gas turbine is held as described in conjunction with FIG. 2 as well as the method for controlling the extinguishment of the flame of the Fs nozzle 1.

Namely, according to the method of the present invention, depicted in FIG. 4 the opening of the Fs nozzle 1 is increased until the time immediately before the rotational frequency of the turbine is maintained, and the opening of the Fs nozzle 1 is reduced as shown by a segment 7 from the time immediately before the rotational frequency of the turbine is maintained to the time immediately after it is maintained.

By so doing, when the rotational frequency of the turbine is maintained, the first stage combustion zone can be prevented from being brought into the state below the fuel lean limit.

Further, according to the method for controlling the extinguishment of the flame of the Fs nozzle 1 according to the present invention, in case of extinguishing the flame of the Fs nozzle 1 as the rotational frequency of the turbine reaches the specified rotational frequency, the valve is not closed in a moment as in the case of the prior art shown by the dotted line in FIG. 4 but the opening of the Fs nozzle 1 is reduced step by step as shown by the segment 8.

By so doing, it is possible to prevent extinguishment of the flame of the F1 nozzle 1 and a abrupt change of the state of a gas turbine due to instantaneous extinguishing of the flame of the Fs nozzle 1.

The flow rate of fuel supplied through the main nozzle 2 is greater than the flow rate of fuel supplied through the auxiliary nozzle 1, Fs usually two to four times as much. Air supplied into the turbine is forced from the outside of the combustor to the inside thereof due to rotation of the turbine, and the flow rate of air supplied into the combustor is changed in accordance with the change in the rotational frequency of the turbine. A specified standard of the total flow rate of fuel supplied to the first stage combustion zone in the combustor depends upon a fixed function (linear function or non-linear step function) of desired rotational frequency of the turbine so that it is increased in proportion to the increase of the desired rotational frequency of the turbine. A specified value of the ratio of the flow rate of fuel supplied into the combustor to the flow rate of air supplied into the combustor depends upon a fixed function (linear function or non-linear step function) of desired rotational frequency of the turbine so that it is determined based on the desired rotational frequency of the turbine. The specified standard of the total flow rate if fuel supplied to the first stage combustion zone in the combustor can also depend upon a fixed function (linear function or non-linear step function) of actual rotational frequency of the turbine so that it is increased in proportion to the increase of the actual rotational frequency of the turbine. The specified value of the ratio fr the flow rate of fuel supplied into the combustor to the flow rate of air supplied into the combustor can also depend on a fixed function (linear function or non-linear step function) of actual rotational frequency of the turbine so that it is determined based on the actual rotational frequency of the turbine.

The ratio of the flow rate of fuel supplied into the combustor to the flow rate of air supplied into the combustor may be changed in accordance with the heat energy of fuel produced when the fuel is combusted. The ratio of the flow rate of fuel supplied into the combustor to the flow rate of air supplied into the combustor may be changed in accordance with the humidity of air used for burning the fuel. When the heat energy of fuel produced when the fuel is combusted is less than a specified value, it may be possible to make the ratio of the flow rate of fuel supplied into the combustor to the flow rate of air supplied into the combustor larger than the specified ratio. When the heat energy of fuel produced when the fuel is combusted is greater than the specified value, it may be possible to make the ratio of the flow rate of fuel supplied into the combustor to the flow rate of air supplied into the combustor less than the specified ratio. When the humidity of air used for burning the fuel is greater than a specified value, it may be possible to make the ratio of the flow rate of fuel supplied into the combustor to the flow rate of air supplied into the combustor greater than the specified ratio. When the humidity of air used for burning the fuel is less than the specified value, it may be possible to make the ratio of the flow rate of fuel supplied into the combustor to the flow rate of air supplied into the combustor less than the specified ratio. When the heat energy of fuel produced when the fuel is combusted less than the specified value, the flow rate of fuel supplied into the combustor can be made greater than the specified standard. When the heat energy of fuel produced when the fuel is combusted is greater than the specified value, the flow rate of fuel supplied into the combustor can be less than the specified standard. When the humidity of air used for combusting the fuel is greater than the specified value, it may be possible to make the flow rate of fuel supplied into the combustor larger than the specified standard. When the humidity of air used for combusting the fuel is less than the specified value, it may be possible to make the flow rate of fuel supplied into the combustor less than the specified standard.

The ratio of the flow rate of fuel supplied into the combustor to the flow rate of air supplied into the combustor may be changed in accordance with the increasing rate of the rotational frequency of the turbine per unit time (acceleration of the turbine). When a desired increasing rate of the rotational frequency of the turbine per unit time is less than a specified value for example, when the rotational frequency of the turbine is maintained, the ratio of the flow rate of fuel supplied into the combustor to the flow rate of air supplied into the combustor can be less than the specified ratio. When the increasing rate of the rotational frequency of the turbine per unit time is less than the specified value, it may be possible to reduce the flow rate of air supplied into the combustor, make the flow rate of fuel supplied into the combustor less than the specified standard and make the ratio of the flow rate of fuel supplied into the combustor to the flow rate of air supplied into the combustor less than the specified ratio.

The ratio of the flow rate of fuel supplied into the combustor to the flow rate of air supplied into the combustor may be changed by reducing the flow rate of air supplied into the combustor by exhausting air forced by the rotation of the gas turbine so as to be supplied into the combustor. When the desired increasing rate of the rotational frequency of the turbine per unit time is less than the specified value, it may be possible to reduce the flow rate of air supplied into the combustor by exhausting to the outside of the combustor part of air forced by the rotation of the gas turbine so as to be supplied into the combustor as well as to make the flow rate of fuel supplied into the combustor less than the specified standard.

The ratio of the flow rate of fuel supplied into the combustor to the flow rate of air supplied into the combustor may be changed by changing the flow rate of fuel injected through the Fs auxiliary nozzle 1. The flow rate of fuel supplied into the combustor can be made smaller than the specified standard by reducing the flow rate off fuel injected through the Fs auxiliary nozzle 1. The flow rate of fuel supplied into the combustor can be made larger than the specified standard by increasing the flow rate of fuel injected through the Fs auxiliary nozzle 1. When the desired increasing rate of the rotational frequency of the turbine per unit time is less than the specified value, the flow rate of fuel supplied into the combustor may be made smaller than the specified standard by making the flow rate of fuel injected through the Fs auxiliary nozzle 1 less than the flow rate of fuel injected through the Fs auxiliary nozzle 1 when the increasing rate of the rotational frequency of the turbine per unit time is larger than the specified value. When the increasing rate of the rotational frequency of the turbine per unit time is less than the specified value so that the flow rate of fuel supplied into the combustor is made smaller than the specified standard, the ratio of the flow rate of fuel supplied into the combustor to the flow rate of air supplied into the combustor may be reduced by reducing the flow rate of fuel injected through the Fs auxiliary nozzle 1. Upon a reduction of the increasing rate of the rotational frequency of the turbine per unit time, the ratio of the flow rate of fuel supplied into the combustor to the flow rate of air supplied into the combustor may be reduced by reducing the flow rate of fuel injected through the Fs auxiliary nozzle 1.

The flow rate of fuel injected through the Fs auxiliary nozzle 1 may be reduced gradually as time elapses. In case of increasing the rotational frequency of the turbine, the flow rate of fuel injected through the Fs auxiliary nozzle 1 may be increased gradually as time elapses. When the desired increasing rate of the rotational frequency of the turbine per unit time is less than the specified value, the flow rate of fuel injected through the Fs auxiliary nozzle 1 may be reduced gradually as time elapses. In case of making the desired increasing rate of the rotational frequency of the turbine per unit time less than the specified value, the flow rate of fuel injected through the Fs auxiliary nozzle 1 may be reduced gradually as time elapses.

What is claimed is:

1. A method for controlling a gas turbine combustor which comprises nozzle means serving to inject a fuel into a combustor and which serves to burn the fuel with air in a combustion chamber so as to drive a gas turbine rotatively by making use of combustion gas compressed as a result of combustion of the fuel, wherein the ratio of a flow rate of fuel supplied into the combustor to a flow rate of air supplied into the combustor is changed in accordance with at least one of a heat energy of fuel produced when the fuel is burnt and a humidity of air used in burning the fuel to prevent a combustion flame from being extinguished by a fuel lean state and a fuel rich state.

2. A method according to claim 1, wherein the flow rate of air supplied into the combustor is changed in accordance with the rotational frequency of the turbine.

3. A method according to claim 1, wherein the flow rate of fuel supplied into the combustor is increased in accordance with the increase of desired rotational frequency of the turbine.

4. A method according to claim 1, wherein the ratio of the flow rate of fuel supplied into the combustor to the flow rate of air supplied into the combustor depends on the desired rotational frequency of the turbine.

5. A method according to claim 1, wherein the flow rate of fuel supplied into the combustor is increased in accordance with the increase of actual rotational frequency of the turbine.

6. A method according to claim 1, wherein the ratio of the flow rate of fuel supplied into the combustor to the flow rate of air supplied into the combustor depends on the actual rotational frequency of the turbine.

7. A method according to claim 1, wherein when a heat energy of fuel produced when the fuel is burnt is smaller than a specified value, the ratio of the flow rate of fuel supplied into the combustor to the flow rate of air supplied into the combustor is made larger than a specified ratio thereof.

8. A method according to claim 1, wherein when a heat energy of fuel produced when the fuel is burnt is larger than a specified value, the ratio of the flow rate of fuel supplied into the combustor to the flow rate of air supplied into the combustor is made smaller than a specified ratio thereof.

9. A method according to claim 1, wherein a humidity of air used in burning the fuel is higher than a specified value, the ratio of the flow rate of fuel supplied into the combustor to the flow rate of air supplied into the combustor is made larger than a specified ratio thereof.

10. A method according to claim 1, wherein a humidity of air used in burning the fuel is lower than a specified value, the ratio of the flow rate of fuel supplied into the combustor to the flow rate of air supplied into the combustor is made smaller than a specified ratio thereof.

11. A method according to claim 1, wherein when a heat energy of fuel produced when the fuel is burnt is smaller than a specified value, the flow rate of fuel supplied into the combustor is made larger than a specified ratio thereof.

12. A method according to claim 1, wherein when a heat energy of fuel produced when the fuel is burnt is larger than a specified value, the flow rate of fuel supplied into the combustor is made smaller than a specified standard.

13. A method according to claim 1, wherein when a humidity of air used in burning the fuel is higher than a specified value, a flow rate of fuel supplied into the combustor is made larger than a specified standard.

14. A method according to claim 1, wherein when a humidity of air used in burning the fuel is lower than the specified value, the flow rate of fuel supplied into the combustor is made smaller than a specified standard.

15. A method according to claim 1, wherein the ratio of the flow rate of fuel supplied into the combustor to the flow rate of air supplied into the combustor is changed in accordance with the acceleration of the turbine.

16. A method according to claim 1, wherein when a desired acceleration of the turbine is smaller than a specified value, the ratio of the flow rate of fuel supplied into the combustor to the flow rate of air supplied into the combustor is made smaller than a specified ratio.

17. A method according to claim 1, wherein when an acceleration of the turbine is smaller than a specified value, the flow rate of air supplied into the combustor is reduced, the flow rate of fuel supplied into the combustor is made smaller than a specified standard and the ratio of the flow rate of fuel supplied into the combustor to the flow rate of air supplied into the combustor is made smaller than a specified ratio.

18. A method according to claim 1, wherein the ratio of the flow rate of fuel supplied into the combustor to the flow rate of air supplied into the combustor is changed by reducing the flow rate of air supplied into the combustor by exhausting to the outside of the combustor a part of the air forced by rotation of the gas turbine so as to be supplied into the combustor.

19. A method according to claim 1, wherein when a desired increasing rate of rotational frequency of the turbine per unit time is smaller than a specified value, the flow rate of air supplied into the combustor is reduced by exhausting to the outside of the combustor a part of the air forced by the rotation of the gas turbine so as to be supplied into the combustor, and the flow rate of fuel supplied into the combustor is made smaller than a specified standard.

20. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and the ratio of the flow rate of fuel supplied into the combustor to the flow rate of air supplied into the combustor is changed by changing the flow rate of fuel injected through the auxiliary nozzle means.

21. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and the flow rate of fuel supplied into the combustor is made smaller than a specified standard by reducing the flow rate of fuel injected through the auxiliary nozzle means.

22. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and the flow rate of fuel supplied into the combustor is made larger than a specified standard by increasing the flow rate of fuel injected through the auxiliary nozzle means.

23. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and when a desired acceleration of the turbine is smaller than a specified value, the flow rate of fuel supplied into the combustor is made smaller than a specified standard by making the flow rate of fuel injected through the auxiliary nozzle means smaller than the flow rate of fuel injected through the auxiliary nozzle means when the increasing rate of rotational frequency of the turbine per unit time is not smaller than the specified value.

24. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and when a desired acceleration of the turbine is smaller than a specified value and the flow rate of fuel supplied into the combustor is made smaller than a specified standard, the ratio of the flow rate of fuel supplied into the combustor to the flow rate of air supplied into the combustor is reduced by reducing the flow rate of fuel injected through the auxiliary nozzle means.

25. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and the flow rate of fuel injected through the auxiliary nozzle means is reduced gradually as time elapses.

26. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and, when the rotational frequency of the turbine is increased, the flow rate of fuel injected through the auxiliary nozzle means is increased gradually as time elapses.

27. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and when a desired acceleration of the turbine is smaller than a specified value, the flow rate of fuel injected through the auxiliary nozzle means is reduced gradually as time elapses.

28. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and, when an actual acceleration of the turbine is made smaller than a specified value, the flow rate of fuel injected through the auxiliary nozzle means is reduced gradually as time elapses.

29. A method according to claim 1, wherein the nozzle means comprises a main nozzle means serving mainly to inject a fuel into the combustion chamber and an auxiliary nozzle means serving to inject a fuel used to form a flame for promoting ignition of the fuel injected through the main nozzle, and, when an acceleration of the turbine is reduced, the ratio of the flow rate of fuel supplied into the combustor to the flow rate of fuel supplied into the combustor is reduced by reducing the flow rate of fuel injected through the auxiliary nozzle means.

* * * * *